US011427457B1

(12) United States Patent
Michelsen et al.

(10) Patent No.: US 11,427,457 B1
(45) Date of Patent: Aug. 30, 2022

(54) CONSUMPTION SAFETY AND QUALITY ASSURANCE FOR FLUID MIXTURE DISPENSING DEVICES

(71) Applicant: Cana Technology, Inc., Redwood City, CA (US)

(72) Inventors: Wayne Michelsen, Menlo Park, CA (US); Gregory Allen Springer, Los Altos, CA (US); Nicholas D. Posner, Redwood City, CA (US); Yashodhan Deshpande, Sunnyvale, CA (US)

(73) Assignee: Cana Technology, Inc., Redwood City, CA (US)

( * ) Notice: Subject to any disclaimer, the term of this patent is extended or adjusted under 35 U.S.C. 154(b) by 0 days.

(21) Appl. No.: 17/549,740

(22) Filed: Dec. 13, 2021

(51) Int. Cl.

| | |
|---|---|
| ***B65D 83/22*** | (2006.01) |
| ***B67D 1/08*** | (2006.01) |
| ***B67D 1/07*** | (2006.01) |
| ***B67D 1/00*** | (2006.01) |

(52) U.S. Cl.
CPC ..... *B67D 1/0888* (2013.01); *B67D 1/0016* (2013.01); *B67D 1/07* (2013.01); *B67D 1/0041* (2013.01)

(58) Field of Classification Search
CPC ..... B65D 83/22; B67D 1/0016; B67D 7/342; B67D 7/34; B67D 7/3218; B67D 7/32; A47K 5/1217; B05B 12/08
USPC ..... 222/129.1, 64, 65, 66, 153.13, 153.14
See application file for complete search history.

(56) References Cited

U.S. PATENT DOCUMENTS

| | | | | |
|---|---|---|---|---|
| 6,807,460 | B2 | 10/2004 | Black et al. | |
| 8,196,776 | B2 | 6/2012 | Majer | |
| 10,029,269 | B2 * | 7/2018 | McNulty | G01N 21/64 |
| 10,373,276 | B2 | 8/2019 | Carpenter et al. | |
| 2004/0011807 | A1 * | 1/2004 | Knepler | B67D 1/1247 222/129.1 |
| 2008/0023486 | A1 * | 1/2008 | Kadyk | A23G 9/045 222/64 |
| 2013/0001249 | A1 | 1/2013 | Wiemer et al. | |
| 2016/0090288 | A1 | 3/2016 | Givens, Jr. et al. | |
| 2017/0172340 | A1 | 6/2017 | Baarman et al. | |
| 2019/0121374 | A1 | 4/2019 | Choubak et al. | |

* cited by examiner

*Primary Examiner* — Vishal Pancholi
*Assistant Examiner* — Robert K Nichols, II
(74) *Attorney, Agent, or Firm* — Daylight Law, P.C.

(57) ABSTRACT

Consumption safety and quality assurance features for fluid mixture dispensing systems, such as a beverage dispensing device, are disclosed. A disclosed beverage dispensing device includes a final dispense chamber and a dispenser for the final dispense chamber. The beverage dispensing device is configured to mix a beverage and store the beverage in the final dispense chamber prior to a final dispense of the beverage from the beverage dispensing device. The beverage dispensing device is further configured to determine at least one parameter of the beverage. The dispenser is locked if the at least one parameter does not satisfy an expected standard and unlocked if the at least one parameter does satisfy the expected standard. The expected standard can be a safety standard or a quality standard.

30 Claims, 7 Drawing Sheets

CONSUMPTION SAFETY AND QUALITY ASSURANCE FOR FLUID MIXTURE DISPENSING DEVICES

BACKGROUND

Automatic beverage dispensing devices often operate without direct professional supervision. For example, devices intended for domestic use and self-service commercial devices are not generally utilized while the personnel that developed or installed the devices are present. Accordingly, these devices are designed to dispense beverages as requested by a user without any intervening quality inspection of the beverage as it is mixed and dispensed. Many different legal and regulatory regimes are in place to assure that devices that create items for consumption operate safely. For example, certain regulations such as the Food Code issued by the United States Food and Drug Administration (FDA) impose criteria for the physical design of beverage dispensers so that minimal requirements are met, such as protection from contaminants. Given the scope of the regulatory regime it is clear that quality assurance in beverage mixture dispensing systems is an important area in which manufacturers must be mindful of numerous safety requirements. Furthermore, regardless of any associate safety issues, assuring that quality is maintained in a device that will be operated by a user is important because there is often no way to detect the user's level of satisfaction through immediate observation. Technologies that improve the safety of beverages dispensed by such devices present an important area for research and development.

SUMMARY

This disclosure relates generally to fluid mixture dispensing systems and methods, and more specifically, to consumption safety features for fluid mixture dispensing systems, devices and methods. In specific embodiments of the invention, the fluid mixture dispensing system can be a beverage dispensing device configured to dispense beverages to be ingested by a user.

Beverage dispensing devices in accordance with specific embodiments of the invention may be configured to dispense a beverage created from at least one ingredient stored in an ingredient reservoir of the device and/or at least one solvent stored in a solvent reservoir of the device. The mixture of ingredient(s) and/or solvent(s) can be provided to a final dispense chamber of the device where the mixture can be held before being dispensed out of the device. The final dispense chamber can include a dispenser that can be unlocked for the beverage to be dispensed out of the device. In specific embodiments of the invention, before the dispenser is unlocked, one or more parameters of the beverage can be determined. The parameters can be associated with an expected standard for the beverage. For example, the expected standard could be a safety and/or quality standard associated with the beverage and/or the manner in which it is made and dispensed. The device can be programmed to allow the dispense of the beverage if the parameter satisfies the expected standard, for example by unlocking the dispenser of the final dispense chamber. The device can be programmed to prevent dispense of the beverage if the parameter does not satisfy the expected standard, for example by keeping the dispenser locked. In specific embodiments of the invention, the dispenser can be locked until an external input is received. The device can be programmed to provide instructions to a user of the device throughout the process, so that the user can operate the device and provide the required inputs.

In specific embodiments of the invention, the parameter of the beverage to be determined can be a parameter that could have an impact in the characteristics of the beverage. Therefore, by allowing a dispense when the parameter satisfies an expected standard but preventing dispense when it does not, the characteristics of the beverage dispensed can be controlled before it is presented to a user of the device. As such, the quality and/or safety of the beverages dispensed by the device can be controlled without expert supervision of the device.

In specific embodiments of the invention, a beverage dispensing device is provided. The beverage dispensing device comprises a final dispense chamber. The beverage dispensing device is configured to mix a beverage and store the beverage in the final dispense chamber prior to a final dispense of the beverage from the beverage dispensing device. The beverage dispensing device also comprises a dispenser for the final dispense chamber. The beverage dispensing device is configured to: determine at least one parameter of the beverage; and at least one of: (i) lock the dispenser if the at least one parameter does not satisfy an expected standard; and (ii) unlock the dispenser if the at least one parameter does satisfy the expected standard.

In specific embodiments of the invention, a method for a beverage dispensing device is provided. The method comprises mixing a beverage in a mixing area of the beverage dispensing device, storing the beverage in a final dispense chamber of the beverage dispensing device, determining at least one parameter of the beverage, and locking a dispenser of the beverage dispensing device, if the at least one parameter does not satisfy an expected standard.

In specific embodiments of the invention, a beverage dispensing device for dispensing a beverage is provided. The beverage dispensing device comprises a final dispense chamber, a dispenser for the final dispense chamber, and a controller storing instructions that, when executed by the controller, cause the beverage dispensing device to: determine at least one parameter of the beverage; allow the beverage to be poured through the dispenser if the at least one parameter satisfies an expected standard; and prevent the beverage from being poured through the dispenser if the at least one parameter does not satisfy the expected standard.

BRIEF DESCRIPTION OF THE DRAWINGS

In the Figures, like reference numbers correspond to like components unless otherwise stated.

DETAILED DESCRIPTION

Reference will now be made in detail to implementations and embodiments of various aspects and variations of systems and methods described herein. Although several exemplary variations of the systems and methods are described herein, other variations of the systems and methods may include aspects of the systems and methods described herein combined in any suitable manner having combinations of all or some of the aspects described.

Different components and methods for a beverage dispensing device will be described in detail in this disclosure. The methods and systems disclosed in this section are nonlimiting embodiments of the invention, are provided for explanatory purposes only, and should not be used to constrict the full scope of the invention. It is to be understood that the disclosed embodiments may or may not overlap with each other. Thus, part of one embodiment, or specific embodiments thereof, may or may not fall within the ambit of another, or specific embodiments thereof, and vice versa. Different embodiments from different aspects may be combined or practiced separately. Many different combinations and sub-combinations of the representative embodiments shown within the broad framework of this invention, that may be apparent to those skilled in the art but not explicitly shown or described, should not be construed as precluded.

Figure 1A:
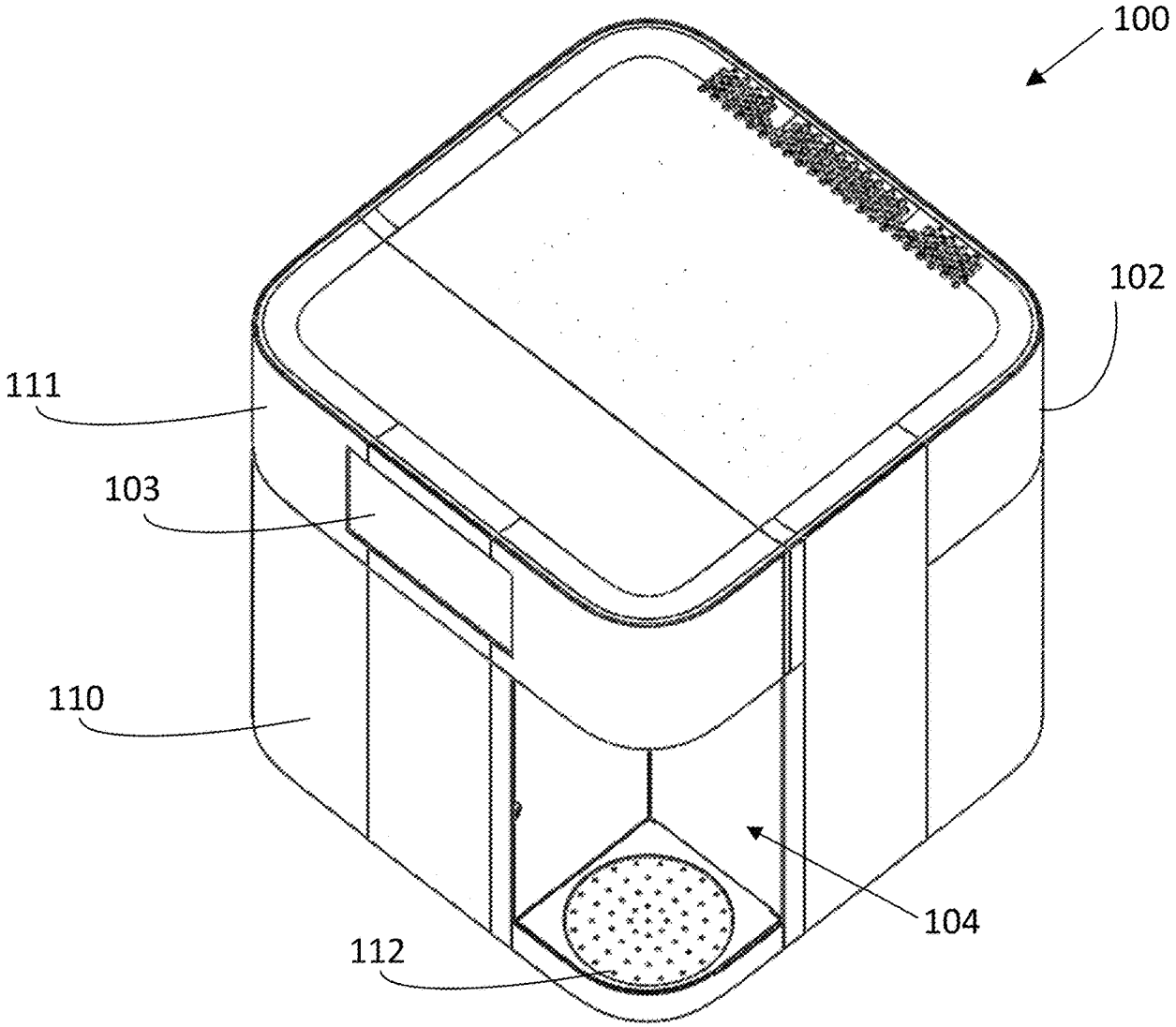
FIG. 1A illustrates an example of a beverage dispensing device, in accordance with specific embodiments disclosed herein.

FIG. 1A illustrates an example of a beverage dispensing device 100, in accordance with specific embodiments disclosed herein. The beverage dispensing device 100 can be any of the fluid mixture dispensing device such as those described in U.S. Provisional Patent Application No. 63/146,461 filed Feb. 5, 2021, which is incorporated by reference herein in its entirety for all purposes.

The beverage dispensing device 100 can include a casing, such as casing 102, that can house various internal components of the device. The casing 102 can include various accesses to the interior of the device. The accesses can be in the form of doors, such as upper access door 111 and lower access door 110. The accesses can also be removable portions, such as lids or walls of the casing. The accesses can be configured so that a user of the device can access at least part of the interior of the device, for example to replace a component, to clean the device, etc., as will be described below in more detail.

The beverage dispensing device can also include a user interface, such as user interface 103. The user interface 103 can include any means for outputting information from the device to a user of the device, and for inputting information from the user of the device to the device. In this way, the user interface can include any means that facilitate the interaction of a user of the device with the device, including but not limited to a display, a speaker, a microphone, a camera, various sensors such as light and presence sensors, etc. For example, the user interface can include a touch screen display, so that the device can display information for the user via the display, and the user can provide inputs to the device via the touch screen display. As another example, the interaction between the user and the device can be via auditory cues provided by the device via a speaker and voice commands from the user received via a microphone. As another example, the device can recognize user facial expressions and gestures via cameras and sensors. The user interface components can be associated to a controller of the device so that the controller can administrate the information to be outputted and process the information being received.

The beverage dispensing device 100 can also include a dispense area, such as dispense area 104. Dispense area 104 can be the area where a beverage is dispensed out of the device 100. Dispense area 104 can be an area configured to receive a vessel or other containers to dispense a beverage out of device 100. The dispense area 104 can be sized so that different containers (for example a wine glass) can be placed therein. In specific embodiments of the invention, the dispense area 104 can be adjusted, for example by using a height adjustable tray. The dispense area 104 can include a waste outlet, such as waste outlet 112. The waste outlet can be a removable waste outlet, such as a removable drip tray.

Figure 1B:
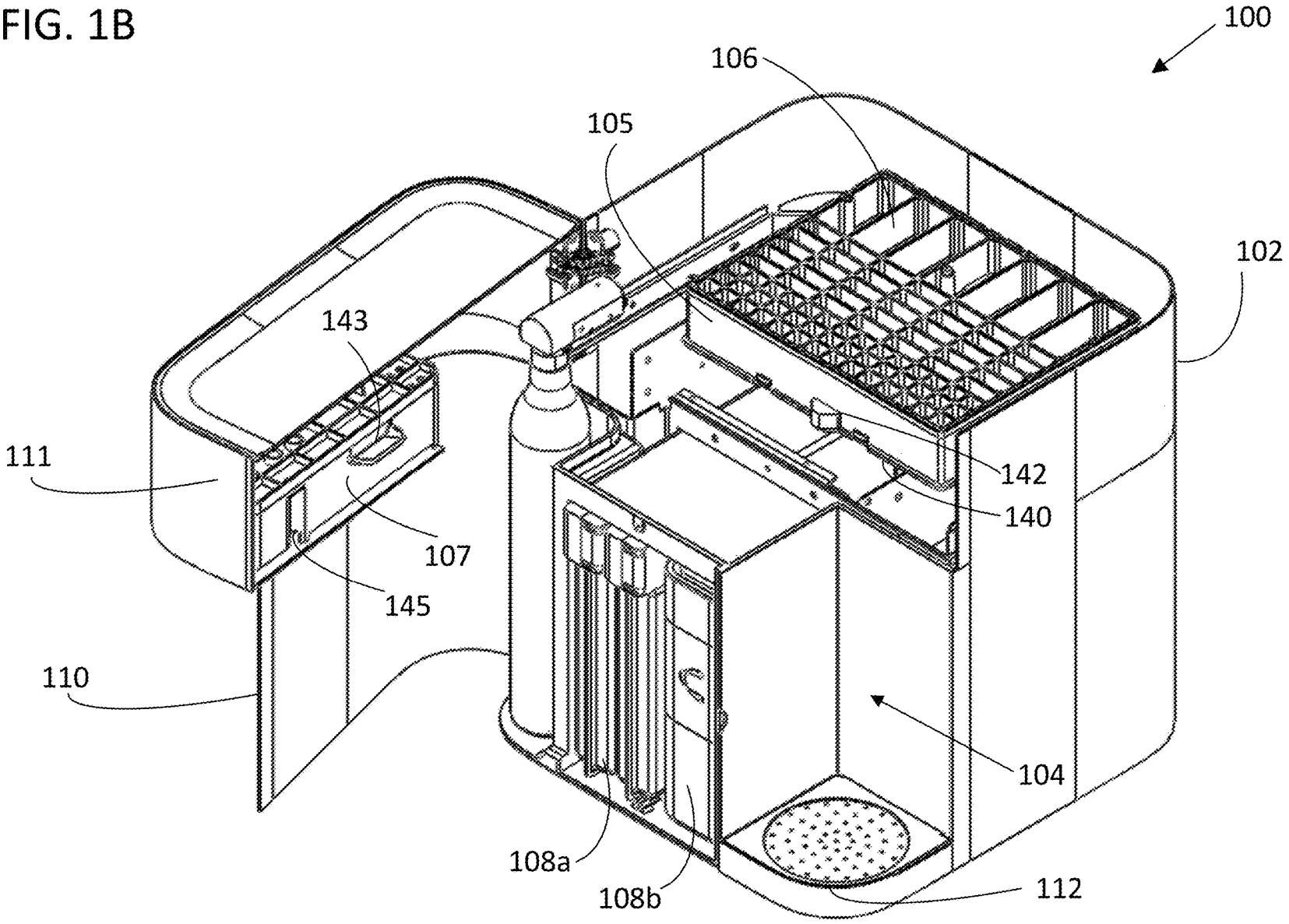
FIG. 1B illustrates exemplary internal components of a beverage dispensing device, in accordance with specific embodiments disclosed herein.

FIG. 1B illustrates the beverage dispensing device 100 of FIG. 1A in an open configuration to illustrate exemplary internal components that can be housed by the casing 102 of the beverage dispensing device 100, in accordance with specific embodiments disclosed herein. The accesses, such as upper access door 111 and the lower access door 110, are open in this figure. The doors can be attached to the remainder of the casing via hinges or other structure. The doors can alternatively be removable doors so that they are completely removed when open. The doors can be any kind of doors such as sliding doors, and open in any direction, for example to the top or to the right of the device. Doors 111 and 110 can be separate doors or a unitary door of the device. In this example, the access doors have been represented in the front wall of the device. However, this is not a limitation of the invention. Different doors and/or any access to the interior of the device can be located anywhere on the device, and do not need to be located on the front wall. In the example of FIG. 1B, a portion of the top wall of the device 100 has been removed to expose some additional exemplary components of the device.

The beverage dispensing device 100 can include one or more ingredient reservoirs, such as ingredient reservoir 106. The ingredient reservoirs can store ingredients to be used by the beverage dispensing device 100 to create a beverage, such as concentrated liquids (e.g., flavor syrups, salts, acids, etc.) The ingredient reservoirs can be any of the ingredient reservoirs described in U.S. patent application Ser. No. 17/545,699 filed Dec. 8, 2021, all of which is incorporated by reference herein in its entirety for all purposes.

The ingredient reservoirs, such as ingredient reservoir 106, can be located in a cartridge, such as cartridge 105. The cartridge can be accessed via one of the accesses of the device. For example, the cartridge can be accessed through upper access door 111. In this way, a user of the device can replace the cartridge as needed. In the example of FIG. 1B, the top surface of cartridge 105 has been removed to expose the ingredient reservoirs 106. However, the cartridge can be completely encased. In specific embodiments of the invention, the cartridge includes a removable lid so that the various ingredient reservoirs can be accessed, for example to be refilled. The cartridge can be any of the cartridges described in U.S. Provisional Patent Application No. 63/146,461 filed Feb. 5, 2021, U.S. patent application Ser. No. 17/547,081 filed Dec. 9, 2021, U.S. patent application Ser. No. 17/547,612 filed Dec. 10, 2021, and U.S. patent application Ser. No. 17/545,699 filed Dec. 8, 2021, all of which are incorporated by reference herein in their entirety for all purposes.

The beverage dispensing device 100 can also include one or more solvent reservoirs, such as solvent reservoirs 108*a* and 108*b*. The solvent reservoirs can store solvents to be used by the beverage dispensing device 100 to create a beverage, such as water, alcohol, etc. The solvent reservoirs can be any of the solvent reservoirs described in U.S. Provisional Patent Application No. 63/146,461 filed Feb. 5, 2021 and U.S. patent application Ser. No. 17/547,081 filed Dec. 9, 2021, all of which are incorporated by reference herein in their entirety for all purposes. The solvent reservoirs can be accessed via one of the accesses of the device. For example, the solvent reservoirs can be accessed through lower access door 110. In this way, a user of the device can remove the solvent reservoirs as needed, for example to refill a water tank.

The beverage dispensing device 100 can be configured to create a beverage by mixing one or more ingredients from one or more ingredient reservoirs 106 and/or one or more solvents from one or more solvent reservoirs 108. A controller of the system can have knowledge of the amount of each ingredient and/or solvent needed for a given recipe and cause the device to dispense the required amount of ingredient and/or solvent to a mixing area of the device. The mixing area can be formed on a bottom plate, such as plate 140, of the ingredient cartridge. Ingredients from the ingredient reservoirs 106 and solvent from the solvent reservoirs 108 can flow from the respective reservoirs to the mixing area of the device 100. In specific embodiments of the invention, the ingredients from the ingredient reservoirs 106 flow to the mixing area and solvent from the solvent reservoirs 108 flow though the mixing area to "collect" the ingredients dispensed therein. In specific embodiments of the invention, solvent from the solvent reservoirs 108 is allowed to enter the mixing area, and the ingredients from the ingredient reservoirs are dispensed from the reservoirs directly into the solvent already in the mixing area. In any case, an intermediate mixture of one or more ingredients and/or one or more solvent can be formed in the mixing area of the device.

The term "intermediate mixture" is used herein to refer to a mixture being created in the mixing area of the device (for example in one or more mixing channels formed on plate 140) that is yet to be dispensed out of the mixing area and to a final dispense chamber of the device. FIG. 1B illustrates a fluid outlet 142 of the cartridge. Fluid outlet 142 can be connected to the mixing area and allow the intermediate mixture formed therein to flow out to a final dispense chamber 107. The final dispense chamber can be any of the final dispense chambers described in U.S. Provisional Patent Application No. 63/146,461 filed Feb. 5, 2021 and U.S. patent application Ser. No. 17/548,318 filed Dec. 10, 2021, all of which are incorporated by reference herein in their entirety for all purposes.

When the access door 111 is closed, the final dispense chamber 107 can be connected to the fluid outlet 142 of the cartridge via the fluid inlet 143. Once in the final dispense chamber 107, the intermediate mixture can be turned into the final beverage to be dispensed by the device 100. In specific embodiments of the invention, the final beverage is the intermediate mixture itself, as received from the mixing area. Alternatively, or in combination, the intermediate mixture can be further mixed with other ingredients (for example sugar water, carbonated water, etc.) in the final dispense chamber to create the final beverage. Alternatively, or in combination, the intermediate mixture can be submitted to other processes such as further mixing, temperature adjustments, carbonation, etc. in the final dispense chamber 107 to create the final beverage. The final beverage can then be dispensed out the final dispense chamber 107 and to the dispense area 104 via a dispenser, such as dispenser 145.

In specific embodiments of the invention, while the final beverage is stored in the final dispense chamber 107 and/or before it is dispensed out of the device 100, an assessment of the beverage can be conducted by the device. In specific embodiments of the invention, the assessment can include determining if the beverage is adequate for dispense. This assessment can be conducted by determining if one or more parameters of the beverage in the final dispense chamber satisfy an expected standard. The expected standard can be a quality standard or a safety standard.

In specific embodiments of the invention, the beverage dispensing device can be configured to automatically dispense beverages that are adequate for dispense (e.g., that satisfy the expected standard). For example, the beverage dispensing device 100 can be configured to allow the beverage to be poured out of the final dispense chamber 107, for example by unlocking the dispenser 145, if the one or more parameters satisfy the expected standard. In specific embodiments of the invention, the beverage dispensing device can be configured to prevent automatic dispense of beverages that are not adequate for dispense (e.g., that do not satisfy the expected standard). For example, the beverage dispensing device 100 can be configured to prevent the beverage from being poured out of the final dispense chamber 107, for example by locking the dispenser 145, if the one or more parameters do not satisfy the expected standard.

The expected standard can be a range of acceptable levels for one or more parameters of the beverage. In this way, if a value for a determined parameter is not within the acceptable range, it can be said that the parameter does not satisfy the expected standard. The expected standard can be given by reference values for the one or more parameters. The reference values can be stored in memory, either locally or accessed remotely, and accessible to a controller of the device. In this way, a determination of the adequacy of the beverage for dispense can be made by the controller by comparing the one or more parameter of the beverage with the expected standard stored in memory. The reference values can be based on previous characterizations of the type of beverage, a recipe for the beverage, test data on the beverage, user preferences, device manufacturer requirements, etc.

In specific embodiment of the invention, the expected standard can be a quality standard. In those embodiments, the determination of the parameter can be used to detect if the beverage is within an acceptable quality level. For example, if the taste, temperature, etc. of the beverage are satisfactory (for example if the beverage has the quality of a beverage described in a recipe or customized by a user). In specific embodiments of the invention, the expected standard is a safety standard. In those embodiments, the determination of the parameter can be used to detect if the beverage is safe for the user to ingest it. In specific embodiments of the invention, a quality standard and a safety standard are the same. However, in other embodiments, those standards can be implemented differently so that the device can have, for example, two levels of determination: a quality standard, in which the device can determine that the beverage may not taste as expected (for example because too much water was added); and a safety standard, in which the device can determine that the beverage may be dangerous (for example too hot and comprising unacceptable concentrations of alcohol, acid, or other substances).

Any other expected standard can be implemented in accordance with this invention, for example a standard determined by a device manufacturer and/or customized by a user of the device. In any case, the device can be able to determine a parameter of the beverage and dispense the beverage if the parameter satisfies the expected standard but prevent dispense if not.

The one or more parameters can be any parameter that characterizes the beverage and therefore can be used to determine if the beverage is adequate for dispense. The parameters of the beverage can be a property of the beverage, a mechanical performance parameter of the beverage dispensing device while making the beverage, a measurement from the final dispense chamber (e.g., volume in the final dispense chamber). For example, the parameter can include a property of the beverage such as a volume, a temperature, a degree of carbonation, a concentration of an ingredient, an amount of water, an amount of alcohol, etc. The parameter can be determined by the device using one or more sensors or other components, as will be described below in more detail with reference to FIG. 2.

Figure 2:
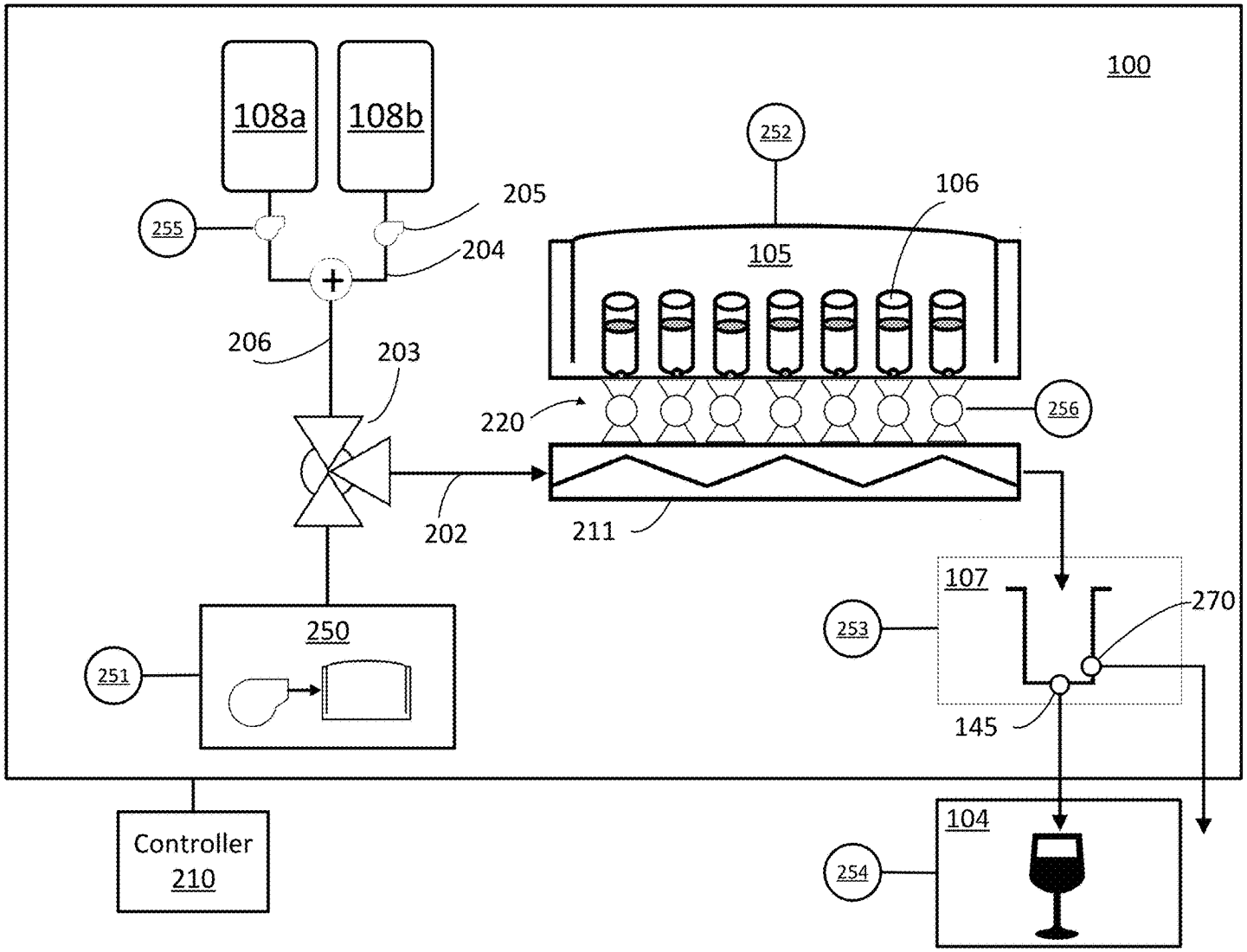
FIG. 2 illustrates a block diagram including exemplary components of a beverage dispensing device in accordance with specific embodiments disclosed herein.

FIG. 2 illustrates a schematic representation of the beverage dispensing device 100 of FIG. 1A and FIG. 1B, in accordance with specific embodiments disclosed herein. FIG. 2 illustrates the ingredient cartridge 105 comprising a plurality of ingredient reservoirs 106, connected to a mixing area 211 via a plurality of valves 220. The valves 220 can be actuated (for example by a controller 210) through plate 140 illustrated with reference to FIGS. 1A and 1B, to unseal the ingredient reservoirs 106 and allow the ingredients to flow to the mixing area 211. FIG. 2 also illustrates the solvent reservoirs 108*a/b* connected to the mixing area 211 via one or more solvent lines (such as individual solvent lines 204 and/or mixed solvent line 206) and one or more input lines, such as input line 202. The solvent can be moved from the solvent reservoirs to the mixing area via one or more solvent pumps, such as pumps 205, and one or more valves, such as valve 203. In this way, an intermediate mixture of one or more ingredients and/or one or more solvents can be formed in the mixing area 211.

FIG. 2 also illustrates a pneumatic system 250 of the beverage dispensing device. The pneumatic system can be any of the pneumatic systems described in U.S. Provisional Patent Application No. 63/146,461 filed Feb. 5, 2021 and U.S. patent application Ser. No. 17/548,258 filed Dec. 10, 2021, all of which are incorporated by reference herein in their entirety for all purposes. The pneumatic system can be configured to force air into the mixing area 211, for example via input line 202 and through one or more valves, such as valve 203. The air from the pneumatic system can be used to move the intermediate mixture through the mixing area 211. For example, the air from the pneumatic system can be used to move the intermediate mixture out of the mixing area 211 and to the final dispense chamber 107.

As mentioned before in this disclosure, one or more parameters of the beverage can be determined before the beverage is dispensed out of the final dispense chamber 107. The one or more parameters can be determined, for example, using sensors at various points of device 100. FIG. 2 illustrates non-limiting examples of sensors, such as sensors 251, 252, 253, 254, 255 and 256. The sensors can be any kind of sensors suitable for determining a parameter of the beverage, such as temperature sensors, strain sensors, pressure sensors, flow sensors, viscosity sensors, voltage sensors, current sensors, optical sensors such as visible light, ultraviolet or infrared sensors, audio sensors, etc. As mentioned in examples below, the same type of sensors can be used in different ways to determine a parameter of a beverage. For example, an audio sensor could detect a mechanical failure of the system as it is generating a beverage and could in combination or in the alternative detect a level of carbonation in the beverage. The sensors can be more dedicated sensors such as sensors that detect the presence or absence of a given substance, or a concentration of a substance. The term sensor will be used in this disclosure in accordance with its general meaning in the art, to refer to any device for detecting and/or measuring any property of the beverage, regardless of the specific examples mentioned in this disclosure. The sensors can be located at any point in the device so long as they are suitable for determining one or more parameters of the beverage.

In specific embodiments of the invention, the parameter can be associated to the mechanical performance of the device. In those embodiments, determining the one or more parameters can include determining the status of certain components of the device that could impact the final beverage. Mechanical failures of some components of the device could translate into an inadequate beverage for various reasons. For example, a valve (such as one or more of valves 220 and/or valve 203) that does not open when instructed to do so may result in an ingredient/solvent missing in the final beverage. A valve that is open more time than what is required for a given beverage may result in a beverage with an excessive amount of an ingredient (for example too much water or too much alcohol). A stuck valve may result in an ingredient present in the final beverage in the wrong concentration. A pump (such as solvent pumps 205) that does not turn on, or that is on more time than necessary for a given beverage, may result in more substance than required, or no substance at all, present in the final beverage.

When the parameter is a mechanical performance parameter of the device, the means for detecting the parameter can be any means to detect a failure in the system. Various ways to make this determination are disclosed in in U.S. Provisional Patent Application No. 63/146,461 filed Feb. 5, 2021, U.S. patent application Ser. No. 17/547,716 filed Dec. 10, 2021, and U.S. patent application Ser. No. 17/547,612 filed Dec. 10, 2021, all of which are incorporated by reference herein in their entirety for all purposes. A failure can be detected, for example, by using sensors, such as current sensors, that measure a current drawn by a given component. For example, sensors such as sensor 255 can measure a status of the pumps, to determine if the pumps have been turned on/off when required. The measurements from the sensors can be used to determine if the pumps allowed the right amount of ingredient to flow to the mixing area. If an error is detected, then it can be inferred that the mechanical failure could have translated into a dispense error, and therefore the final beverage may not be the expected beverage.

In a similar way, sensors (such as sensor 256) can measure the performance of the valves, such as valves 220 and 203. The sensors can be, for example, current sensors and measure a current draw of electromechanical valves, to determine if the valves have been energized/de-energized to allow the ingredients to flow through them. The measurements from the sensors can be used to determine if the valves allowed the right amount of ingredient to flow to the mixing area. If an error is detected, then it can be inferred that the mechanical failure could have translated into a dispense error, and therefore the final beverage may not be the expected beverage.

In this way, the status of one or more components of the device (such as the one or more valves/pumps that allow ingredients and/or solvents to flow to the mixing area 211) can be monitored. If it is detected that one or more of the components is malfunctioning, it can be inferred that the beverage may not satisfy the expected standard. Various ways to make this determination are disclosed in in U.S. Provisional Patent Application No. 63/146,461 filed Feb. 5, 2021, U.S. patent application Ser. No. 17/547,716 filed Dec. 10, 2021, and U.S. patent application Ser. No. 17/547,612 filed Dec. 10, 2021, all of which are incorporated by reference herein in their entirety for all purposes.

In specific embodiments of the invention, the parameter can be a beverage volume. The system can be configured to determine the volume of the final beverage stored in the final dispense chamber in various ways. The expected standard in this case can be an expected volume for the given beverage. If the measured and expected volumes match, it can be said that the parameter satisfies the expected standard. If not, the parameter does not satisfy the expected standard and it can be inferred that the beverage is not the expected beverage. In specific embodiments of the invention, a tolerance range can be considered between the detected parameter and the expected standard, so that the system can account for fluctuations in the parameter that are do not necessarily indicate that the beverage does not satisfy the expected standard. For example, in the case where the parameter is a volume, the measured volume and the expected volume do not need to be an exact match. Instead, the divergence can be between acceptable tolerance ranges. The tolerance ranges can be stored in memory accessible to the controller and can be set by a device manufacturer and/or device administrator, for example based on known data for similar processes.

When the parameter is associated with the volume of the beverage, the means for detecting the parameter can be any means to measure or infer a volume. The system can include volume sensors for this purpose. For example, one or more sensors, such as sensor 253, can be configured to determine a volume in the final dispense chamber 107. The sensors can be volume sensors or any other sensor that determine the volume in the chamber, such as presence sensors located at an expected height in the chamber, so that if the content in the chamber does not reach such height, or if it surpasses it for more than a threshold, it can be inferred that the beverage is not the expected beverage. As another example, sensors, such as sensor 253, can be optical sensors to determine a volume of the beverage in the final dispense chamber 107 using optical, infrared, or ultraviolet light. As another example, one or more sensors, such as sensor 252, can be configured to determine a volume in the cartridge or the individual ingredient reservoirs. Alternatively, or in combination, the volume can be derived from other measurements, for example a pressure or a current as described in U.S. Patent Application Ser. No. 17/547,716 filed Dec. 10, 2021, and U.S. patent application Ser. No. 17/547,612 filed Dec. 10, 2021.

In specific embodiments of the invention, the parameter can be a volume left of an ingredient in a reservoir, and not necessarily the volume of the ingredients dispensed for the beverage or the volume of the beverage itself. For example, a volume sensor, or other sensor, can detect that the amount of substance (e.g., a solvent such as water or any other ingredient) that was left in a reservoir was not enough for the beverage requirements, and therefore it can be inferred that the beverage may not be the expected beverage.

In specific embodiments of the invention, the parameter can be the concentration of one or more substances in the final beverage. The concentration can be determined using one or more sensors, such as sensor 253 in the final dispense chamber 107. The sensors can be dedicated sensors for this purpose or other means such as electrodes that measure conductivity through the beverage. Current sensors can also be used for this purpose to determine the conductivity of the beverage with the conductivity being a proxy for an alcohol content of the beverage compared to pure water. In this case, the expected standard can be an expected concentration of the substance for the given beverage.

In specific embodiments of the invention, the parameter can be a temperature of the final beverage. The temperature can be determined by using temperature sensors. In this case, the expected standard can be an expected temperature for the given beverage. The expected standard can, of course, change from one beverage to another. In the example of the temperature, the expected standard for a coffee (hot) may be different that the expected standard for a juice (chilled). The temperature sensor can be a thermometer configured to be immersed in the beverage or an infrared camera configured to scan a surface of the beverage.

In specific embodiments of the invention, the parameter can be associated to the pneumatic system performance. For example, the parameter can be a pressure in the ingredient cartridge as set by the pneumatic system for dispensing the ingredient out of the cartridge. The parameter can be a flow of air entering the mixing area to move the intermediate mixture. The parameter can be a flow of air entering the mixing area to clean the mixing area, etc. One or more sensors, such as sensor 251, can be located at various points of the system and associated to the pneumatic system. For example, the sensors can be pressure sensors to determine the pressure being provided by the pneumatic system. The sensors can be flow sensors located in the lines to determine if the air flow is enough to move the mixture, etc. A failure or malfunctioning of the pneumatic system could translate into a beverage that does not satisfy an expected standard in that the intermediate mixture may not be moved completely to the final dispense chamber if not enough air pressure is provided to the mixing area. As another example, if the pneumatic system is used to clean the mixing area in between beverages a failure of the pneumatic system may result in carry over ingredients from a previous beverage being mixed with a subsequent beverage. These and other undesired conditions may result in a beverage that does not satisfy a given standard.

The examples above are non-limiting illustrative examples of the parameters that can be determined by the system to determine if the parameter satisfies the expected standard. Other parameters can be determined such as a degree of carbonation, color of the beverage, the pH of the beverage, the degree of viscosity, etc. For example, a visible light camera can determine the color of the beverage as it sits in a final dispense chamber, as it is being dispensed, or at any point during the mixing process. In any case, the device can include the means to determine such parameter and allow or prevent dispense of the beverage based on an expected standard for the parameter.

Figure 3:
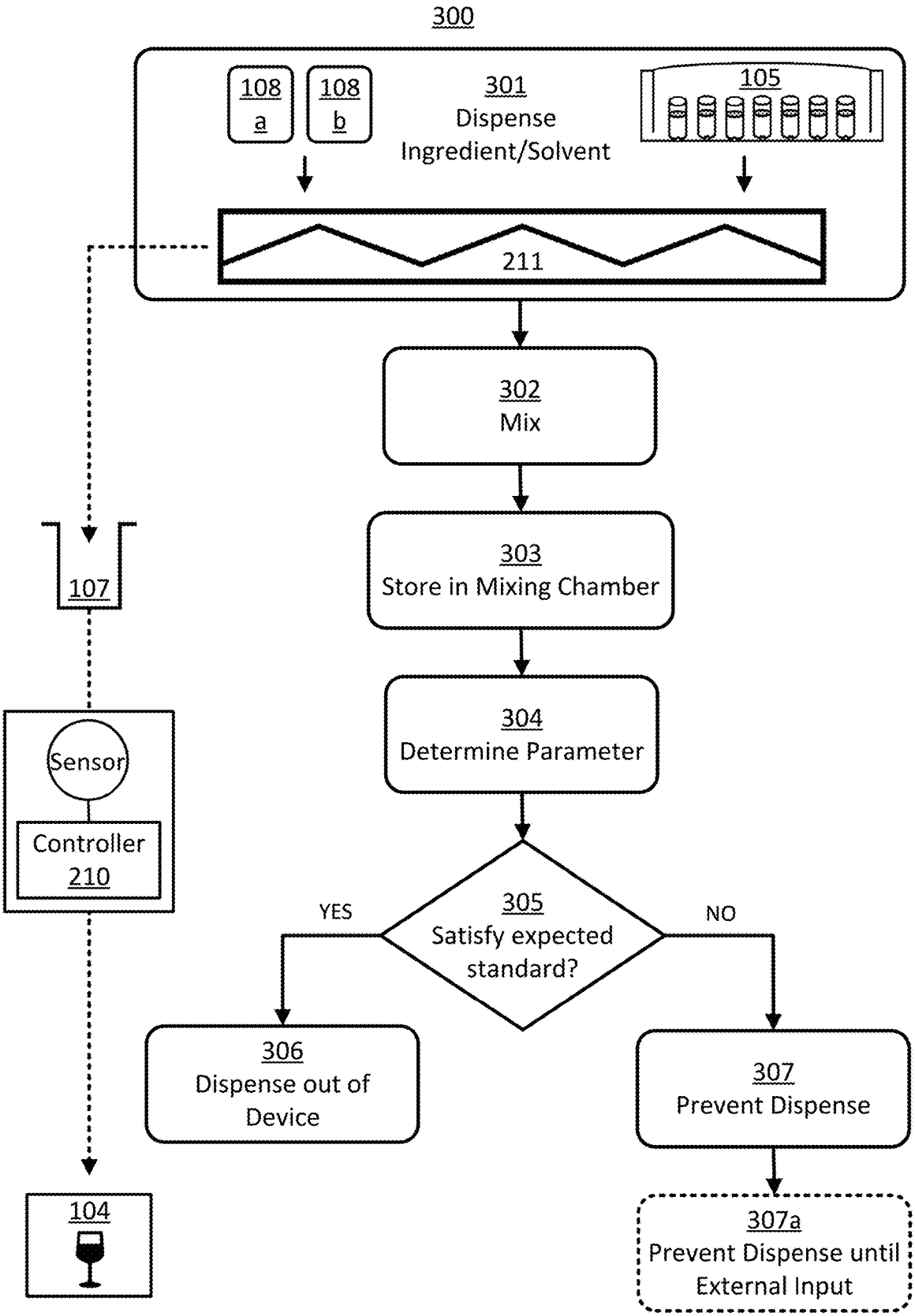
FIG. 3 illustrates a first flowchart for a set of methods for a beverage dispensing device, in accordance with specific embodiments disclosed herein.

FIG. 3 illustrates a first flowchart 300 for a set of methods for a beverage dispensing device, in accordance with specific embodiments disclosed herein. Flowchart 300 starts with a step 301 of dispensing at least one substance to the mixing area 211. As illustrated, the substance can include one or more solvents, such as a solvent from a solvent reservoir 108*a/b*, and/or one or more ingredients from an ingredient reservoir in cartridge 105. Flowchart 300 continues with a step 302 of producing an intermediate mixture. As explained before in this disclosure this step can include the process of the ingredients and/or solvents being dispensed to and coming together in, the mixing area 211. Step 302 can include the pneumatic system moving the ingredients and/or solvents through the mixing area as also explained before in this disclosure. Step 302 can be followed by a step 303 of moving the intermediate mixture out of the mixing area 211 and to the final dispense chamber 107 for finalizing the beverage. Step 303 can be performed by using the forced air of the pneumatic system to move the intermediate mixture out of the mixing area. A dispense outlet of the final dispense chamber 107, for example dispenser 145, can be in a locked state so that the mixture does not flow directly out of the device and is instead momentarily stored therein. The dispense outlet can then be transferred to an unlocked state so that the mixture can be allowed to flow directly out of the device. The locked state can be set by a controller of the device which has the ability to send interrupt signals, or otherwise block other control signals, to keep the dispense outlet in a locked state and not dispensing regardless of whether other control systems are attempting to instruct the dispenser to dispense.

Step 303 can be followed by a step 304 of determining a parameter of the beverage. The parameter can be any of the parameters described before in this disclosure. Step 304 can include measuring the parameter, for example by using the sensors described before in this disclosure and/or processing the measured parameter by a controller. Step 304 can be followed by a decision step 305 in which it can be determined if the parameter satisfies an expected standard. As explained before in this disclosure, the expected standard can be a reference standard for the parameter determined in step 304. Step 305 can be performed by a controller such as controller 210. For example, the controller can have access to the expected standard, which can be stored in memory locally or accessed remotely from other services and compare such standard to the measured parameter.

If the expected standard is satisfied in step 305, step 304 can be followed by a step 306 of dispensing the beverage out of the device. Step 306 can be performed by unlocking a dispense outlet of the final dispense chamber, such as by unlocking dispenser 145. The dispenser can be unlocked/locked under the command of the controller 210. Step 306 can be performed automatically or can be performed in response to an external input. The external input can be a command from a user such as by making a selection via the user interface 103 (e.g., a physical button on the device or a simulated button on a touch screen), or the presence of a vessel placed in the dispense area 104, as sensed by a sensor of the device, etc. In specific embodiments of the invention the device can be configured to operate with a dedicated vessel, for example a drinking vessel that comprises an RFID tag that the device can recognize. In those embodiments, the device can be programmed to conduct step 306 when the dedicated vessel is sensed.

If the expected standard is not satisfied in step 305, step 304 can be followed by a step 307 of preventing automatic dispense out of the device. Step 307 can be performed by locking a dispense outlet of the final dispense chamber, such as by locking dispenser 145, of the final dispense chamber. Dispense can be prevented until an external input is detected as indicated by step 307*a*. Various exemplary implementations of step 307 will be explained with reference to FIG. 5.

In specific embodiments of the invention, step 307 could be the same as step 306 and include automatically dispensing the beverage out of the device. However, preventing dispense of the beverage when the expected standard is not satisfied can be advantageous for various reasons. For example, the beverage may have a bad taste, or not even be safe for ingestion. The beverage can include substances in a concentration which is not to be ingested, or which is not the concentration preferred by the user or indicated in the beverage's recipe. Dispensing such beverage automatically out of the final dispense chamber could result in a user inadvertently ingesting such inadequate beverage. In this sense, it can be advantageous to provide indications to the user that the content of the final dispense chamber is not to be ingested or at least that it is not what the user is expecting. In some embodiments, an input from the user may be necessary to proceed with dispense.

Figure 4:
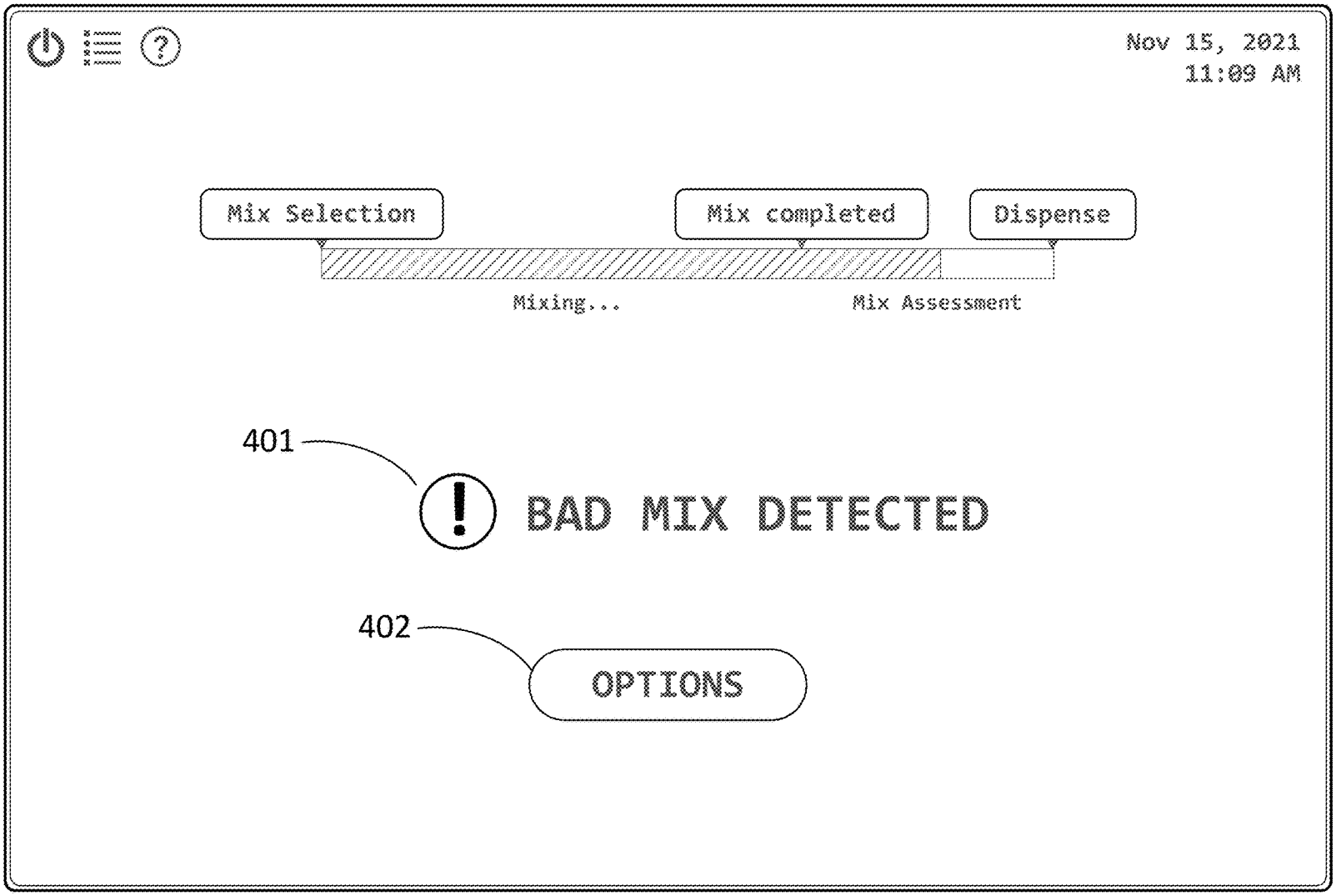
FIG. 4 illustrates an example of a user interface of a beverage dispensing device, in accordance with specific embodiments disclosed herein.

FIG. 4 illustrates an example of a user interface 400, which can be an instance of user interface 103, with an alert message 401 for the user indicating that a bad beverage has been detected. This is a non-limiting illustrative example of the various ways that the user can be informed about the beverage status. As illustrated, the user interface can also provide options 402 to the user so that the user can proceed to operate the device. In specific embodiments of the invention, the message 401 and/or the options 402 can be related to the various possible actions that will be described with reference to FIG. 5. The message 401 and/or the options 402 can inform the user of the status of the beverage and/or provide guidance for the next step to be performed by the user, such as how to proceed to dispense or discard the beverage.

Figure 5:
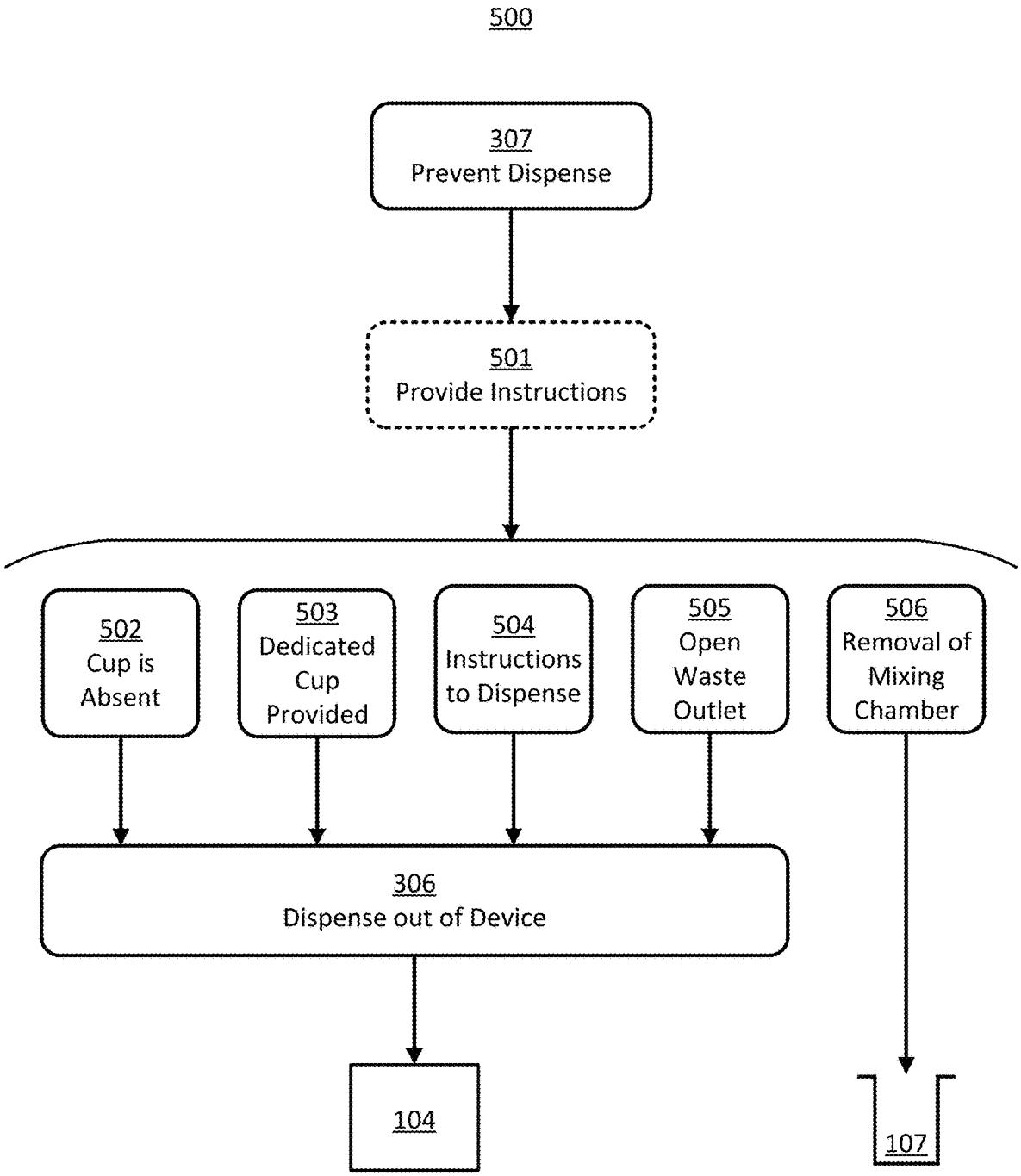
FIG. 5 illustrates a second flowchart for the set of methods for a beverage dispensing device, in accordance with specific embodiments disclosed herein.

FIG. 5 illustrates a flowchart 500 for a set of methods for a fluid mixture dispensing device, including examples of external inputs that can be received from step 307. The external input can include detecting that a vessel is absent from a dispense area, as indicated by step 502. This step can be performed using a sensor in the dispense area of the device (such as sensor 254 in FIG. 2). The sensor can be a presence sensor, an RFID sensor, a light sensor, a weight sensor, a camera, or any other means that can detect the absence of the vessel from the dispense area. In specific embodiments of the invention, this step can be advantageous in that it can be guaranteed that a bad beverage will not be dispensed into a vessel that could potentially be used by a user to ingest the beverage. This step can then be followed by step 306, introduced with reference to FIG. 3, of dispensing the beverage out of the device. The bad beverage can be dispensed, for example, to a waste area of the device, such as a drain of the dispense area, drip tray or similar structure, or to a dedicated drain cup as will be explained with reference to step 503. In this way, the device can detect that a user has removed a drinking vessel and then proceed to dispense the bad beverage when the vessel is absent. In specific embodiments of the invention and as will be described with reference to step 501, the device can provide instructions to remove the drinking vessel from the dispense area. In specific embodiments of the invention, the device can be programmed to wait for an additional input from user to confirm that the drinking vessel has been removed (e.g., a physical or simulated button on the user interface to confirm removal of drinking vessel and proceed to dispense bad beverage).

The external input can also, or alternatively, include detecting the presence of a dedicated container in the dispense area of the device, as indicated by step 503. In specific embodiments of the invention, the dedicated container can be a container with an RFID tag that the device can recognize as a waste container. In specific embodiments of the invention, the dedicated contained can be sensed by sensors in the dispense area, such as the sensors described with reference to step 502. In specific embodiments of the invention, the device can be configured to not dispense the beverage until the specific waste container is provided in the dispense area. In this way, the device can detect that a special container has been placed and it is safe to dispense the beverage without danger of the beverage being inadvertently consumed. In specific embodiments of the invention, the device can provide instructions to place the dedicated vessel in the dispense area, as will be described with reference to step 501. In specific embodiments of the invention, the device is configured to wait for an input from the user to confirm that the dedicated waste container has been placed in the dispense area (e.g., a simulated or physical button on the user interface to confirm removal of drinking vessel and/or placement of waste container).

The external input can also, or alternatively, include receiving instructions to dispense the bad beverage, as indicated by step 504. The instructions can be received from a user of the device and indicate that the user is aware that a bad beverage is going to be dispensed, and not an ingestible beverage. The instructions can be received via user interface 103, a mobile device working in association with the device, or other means.

The external input can also, or alternatively, include opening a waste outlet for the final dispense chamber, as indicated by step 505. This step can be conducted automatically by the device or upon a user intervention, for example by the user pressing a physical or simulated button to open such outlet or by the user manually opening such outlet. In specific embodiments of the invention, the outlet drains the beverage directly to a waste area of the dispense area, such as drip tray 112. A waste outlet of the mixing area can be a separate outlet 270 represented in FIG. 2, which is not the dispense outlet 145. In specific embodiments of the invention, the device can be programmed to automatically (or upon a user input as described herein) drain inadequate beverages through the waste outlet when it is detected that the standard is not satisfied in step 305.

The external input can also, or alternatively, include manual removal of the final dispense chamber, as indicated by step 506. This step can be performed by a user of the device to manually discard the beverage. In specific embodiments of the invention, the device is programmed to only allow new drinks to be made once the final dispense chamber has been emptied.

Figure 6:
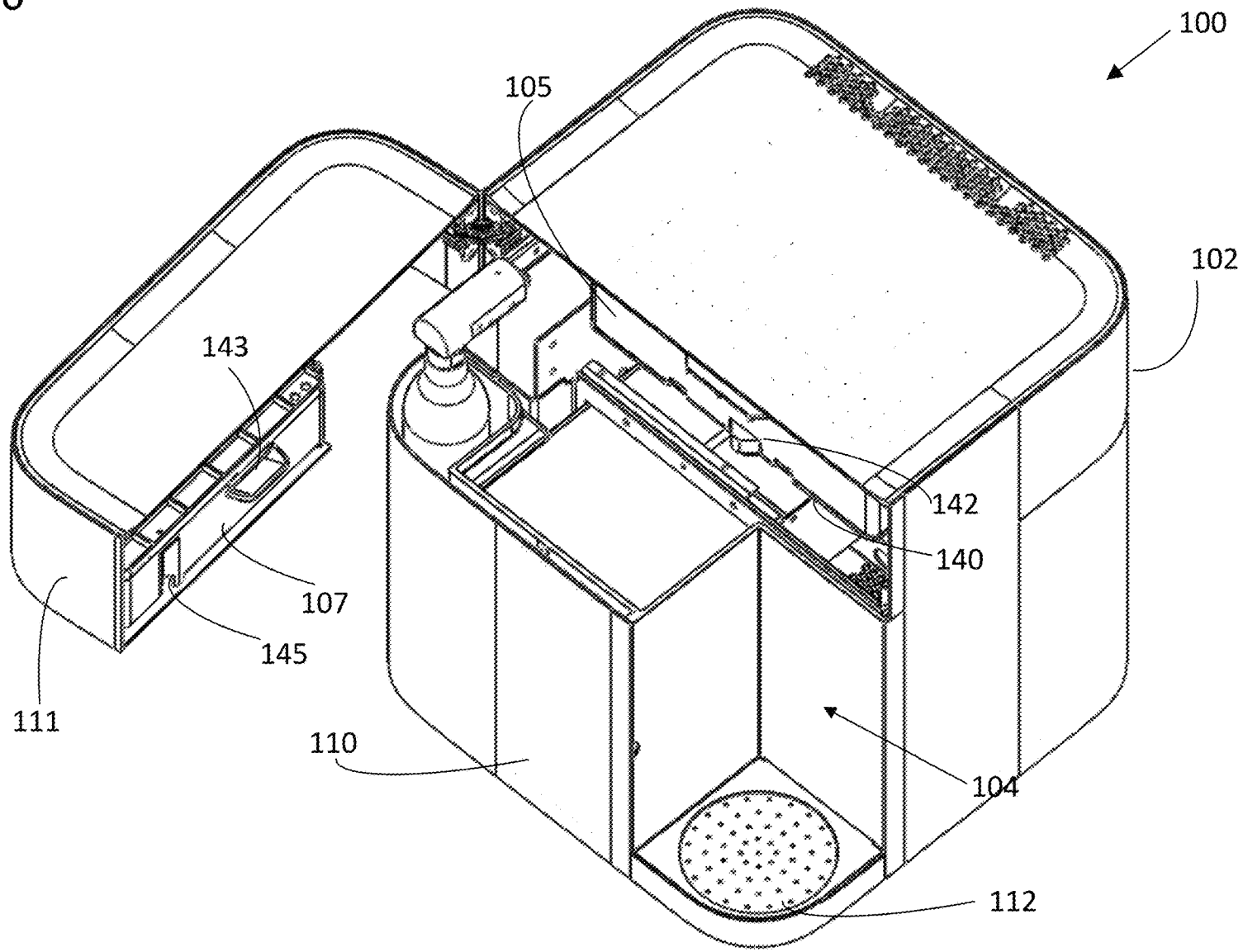
FIG. 6 illustrates a beverage dispensing device in a configuration where a final dispense chamber can be removed, in accordance with specific embodiments disclosed herein.

The final dispense chamber can be removed via one of the accesses of the device. FIG. 6 illustrates an image of the beverage dispensing device 100 with the upper access door 111 open, where the final dispense chamber 107 is exposed. In specific embodiments of the invention, the final dispense chamber is detachable. The final dispense chamber can then be removed by a user, drained and placed back into place. The access door 111 can then be closed and the device can continue to prepare a subsequent drink. The device can be configured to unlock the dispenser 145 upon detecting that the final dispense chamber 107 has been detached and/or that the final dispense chamber 107 has been replaced.

Multiple other external inputs are possible, and the examples given should not limit the scope of this invention. Any action that indicates to the system that there is no risk for dispensing the bad beverage out of the final dispense chamber can be used as an external input.

In specific embodiments of the invention, the system can be configured to provide instructions to the user for any of the inputs disclosed before, as indicated by step 501. Those instructions can be related to the external input that the system is expecting to receive. Those instructions can provide indications to the user as to what action needs to be taken for the beverage to be dispensed out of the final dispense chamber. For example, the instructions can include instructions to remove a vessel from the mixing area. Those instructions can be given before proceeding, for example, with step 502. Other instructions can include instructions to place a dedicated vessel for the bad beverage in the dispense area. Those instructions can be given before proceeding, for example, with step 503. Other instructions can include instructions to guide the user to perform an action to instruct the dispense, for example pressing a "dispense now" bottom or other input that indicates that the user is aware that the bad beverage will be dispensed next. Those instructions can be given before proceeding, for example, with step 504. Other instructions can include instructions to guide the user to open a waste outlet of the final dispense chamber, for example to press a physical or simulated button or to manually open the outlet. These instructions can be provided, for example, before proceeding with step 505.

Other instructions can include instructions to remove the final dispense chamber, such as instructions on how to remove it. Those instructions can be given before proceeding, for example, with step 506. For example, the device can be configured to indicate, via a display of the user interface 103, that the final dispense chamber should be emptied and cleaned when the device locks the dispenser to prevent dispense in step 307.

The above and other instructions can be provided alone or in combination in step 501 and at different points during the cycle. In this way, the user can receive information and/or instructions on the status of the beverage and next steps to be taken throughout the process. The instructions can be provided via the user interface 103, for example as part of the options 402 illustrated with reference to FIG. 4.

In the disclosure above, parameters that impact the beverage before and when such beverage is ready to dispense have been described. However, it can be the case that a beverage does satisfy the quality standard when the parameter is measured in step 304 and when the determination is made in step 305, but the beverage is not subsequently dispensed out of the final dispense chamber. For example, if the user needed to press a physical or simulated button to proceed with dispense in step 306 but did not press it, or if automatic dispense in step 306 failed, the beverage may be held in the final dispense chamber after steps 304 and 305 have been carried out. In those cases, the device can be programmed to detect if the beverage has been left in the final dispense chamber for too long (e.g., for more than a defined period of time), and determine therefrom if the beverage satisfies or does not satisfy the expected standard. For example, steps 304 and 305 can be performed again after the period of time has elapsed, to make a new determination that the beverage satisfies or not the expected standard. Alternatively, or in combination, the device can be programmed to determine that the beverage does not satisfy the expected standard if the beverage is left in the final dispense chamber for too long. In those cases, the user may be instructed to empty the final dispense chamber in any of the ways described above in this disclosure.

In specific embodiments of the invention, the device 100 works in association with one or more servers. The servers can store data such as the reference values for the expected standard described in this disclosure, recipes for the beverages, etc. The servers can also receive data from the device and use that data to determine if an action is needed for the device 100. For example, the measured parameter as well as the result of the determination in step 305 can be reported from the device to a server. This data can be used for numerous purposes such as for dynamic adjustment of the characterization of the expected standard. The data can also be used to supervise the status of the device by a system and take actions in response when necessary. The data can be used for commercial purposes such as when the device is part of a pay per-beverage platform. In the event of the determination that a beverage does not satisfy an expected standard, a user can be compensated in various ways. The server can receive data regarding the failure and action a repair mechanism such as internal calibration, or send a replacement component (e.g., new cartridge) to the user. The device/servers can also determine that the user should not be charged for the inadequate beverage, and/or issue credits for the user of the device as a way to compensate for the inadequate beverage. These and other actions can be performed so that satisfaction of the user can be ensured despite any issues with the beverage dispensing process.

A controller, as used in this disclosure for example with reference to controller 210, can include one or more processors that can be distributed locally within the system or remotely. For example, one or more components of the system, such as valves, pumps, and sensors can be associated to individual microcontrollers that can control their operations and interaction with other components of the system. In specific embodiments of the invention, the controller can be a control system for the overall device even if the various control elements are separately programmed and are not part of a common control hierarchy. The controller can have access to one or more memories that store the instructions for the controllers. The memories can also store information for the system, such as a library of recipes, reference values such as the pressure thresholds and/or target pressure values mentioned in this disclosure, and any other necessary information such as sensor data and the like.

While the specification has been described in detail with respect to specific embodiments of the invention, it will be appreciated that those skilled in the art, upon attaining an understanding of the foregoing, may readily conceive of alterations to, variations of, and equivalents to these embodiments. Any of the method disclosed herein can be executed by a processor in combination with a computer readable media storing instructions for the methods in combination with the other hardware elements described above. These and other modifications and variations to the present invention may be practiced by those skilled in the art, without departing from the scope of the present invention, which is more particularly set forth in the appended claims.

What is claimed is:

1. A beverage dispensing device comprising:
a final dispense chamber, wherein the beverage dispensing device is configured to mix a beverage and store the beverage in the final dispense chamber prior to a final dispense of the beverage from the beverage dispensing device; and
a dispenser for the final dispense chamber;
wherein the beverage dispensing device is configured to:
determine at least one parameter of the beverage;
lock the dispenser if the at least one parameter does not satisfy an expected standard;
provide an instruction related to an external input, when the at least one parameter does not satisfy the expected standard;
detect the external input after providing the instruction, and
unlock the dispenser upon receiving the external input.

2. The beverage dispensing device of claim 1, wherein:
the final dispense chamber is detachable; and
the external input is at least one of: (i) the final dispense chamber has been detached; and (ii) the final dispense chamber has been replaced.

3. The beverage dispensing device of claim 1, further comprising:
a display;
wherein the final dispense chamber is detachable; and
wherein the beverage dispensing device is configured to provide the instruction related to the external input by indicating, via the display, that the final dispense chamber should be emptied when the beverage dispensing device locks the dispenser.

4. The beverage dispensing device of claim 1, further comprising:
at least one sensor; and
a user interface;
wherein the external input includes at least one of:
detecting, using the at least one sensor, that a vessel is absent from a dispense area;
detecting, using the at least one sensor, a presence of a dedicated container in the dispense area;
receiving an input on the user interface; and
detecting manual removal of the final dispense chamber.

5. The beverage dispensing device of claim 1, wherein:
the at least one parameter includes at least one of:
a mechanical performance parameter of the beverage dispensing device;
a volume in the final dispense chamber; and
a property of the beverage.

6. The beverage dispensing device of claim 1, wherein the expected standard includes
a reference range for a value of the at least one parameter.

7. The beverage dispensing device of claim 1, further comprising:
a user interface;
wherein the beverage dispensing device is further configured to:
provide a first indication, via the user interface, that the beverage is not safe; and
provide a second indication, via the user interface, to remove the beverage from the final dispense chamber;
wherein the second indication is the instruction related to the external input.

8. The beverage dispensing device of claim 1, further comprising:
a sensor;
wherein the beverage dispensing device is further configured to only unlock the dispenser, if the at least one parameter does satisfy the expected standard, when a drinking vessel is detected by the sensor; and
wherein detecting the external input includes the sensor detecting a waste container.

9. The beverage dispensing device of claim 8, wherein:
the waste container includes an RFID tag; and
the sensor senses the waste container via the RFID tag.

10. The beverage dispensing device of claim 1, further comprising:
a pneumatic system; and
a sensor of the pneumatic system;
wherein the at least one parameter of the beverage is detected based on measurements from the sensor of the pneumatic system.

11. A method for a beverage dispensing device comprising:
mixing a beverage in a mixing area of the beverage dispensing device;
storing the beverage in a final dispense chamber of the beverage dispensing device;
determining at least one parameter of the beverage;
locking a dispenser of the beverage dispensing device, if the at least one parameter does not satisfy an expected standard;
providing an instruction related to an external input;
detecting the external input after providing the instruction; and
unlocking the dispenser after receiving the external input.

12. The method of claim 11 wherein detecting the external input includes at least one of:
detecting that a vessel is absent from a dispense area;
detecting a presence of a dedicated container in the dispense area;
receiving an input on a user interface; and
detecting manual removal of the final dispense chamber.

13. The method of claim 11, further comprising:
unlocking the dispenser, if the at least one parameter does satisfy the expected standard.

14. The method of claim 11, wherein:
the final dispense chamber is detachable; and
the method further comprises:
unlocking the dispenser upon detecting at least one of: (i) the final dispense chamber has been detached; and (ii) the final dispense chamber has been replaced.

15. The method of claim 11, wherein:
providing the instruction related to an external input includes indicating, via a display, that the final dispense chamber should be emptied when the dispenser is locked.

16. The method of claim 11, further comprising:
draining the beverage through a waste outlet of the final dispense chamber if the at least one parameter does not satisfy the expected standard.

17. The method of claim 11, wherein the at least one parameter includes at least one of:
a mechanical performance parameter of the beverage dispensing device;
a volume in the final dispense chamber; and
a property of the beverage.

18. The method of claim 11, wherein the expected standard includes a reference range for the at least one parameter.

19. The method of claim 11, further comprising:
providing a first indication, via a user interface, that the beverage is not safe; and
providing a second indication, via the user interface, to remove the beverage from the final dispense chamber;
wherein the second indication is the instruction related to an external input.

20. The method of claim 11, further comprising:
unlocking the final dispense chamber when a dedicated container is sensed by a sensor;
wherein the dedicated container when the at least one parameter satisfies the expected standard is a vessel; and
wherein the dedicated container when the at least one parameter does not satisfy the expected standard is a waste container.

21. The method of claim 20, wherein:
the dedicated container includes an RFID tag; and
the sensor senses the dedicated container via the RFID tag.

22. The method of claim 11, further comprising:
receiving a measurement from a sensor of a pneumatic system of the beverage dispensing device;
wherein the determining of the at least one parameter is based on the measurement from the sensor of the pneumatic system.

23. A beverage dispensing device for dispensing a beverage, the beverage dispensing device comprising:
a final dispense chamber, wherein the beverage dispensing device is configured to mix the beverage and store the beverage in the final dispense chamber prior to a final dispense of the beverage from the beverage dispensing device;
a dispenser for the final dispense chamber;
a sensor; and
a controller storing instructions that, when executed by the controller, cause the beverage dispensing device to:
determine at least one parameter of the beverage;
allow the beverage to be poured through the dispenser if the at least one parameter satisfies an expected standard, when a drinking vessel is detected by the sensor;
prevent the beverage from being poured through the dispenser if the at least one parameter does not satisfy the expected standard; and
allow the beverage to be poured through the dispenser after the beverage was prevented from being poured through the dispenser, when a waste container is detected by the sensor.

24. The beverage dispensing device of claim 23, wherein the at least one parameter includes at least one of:
a mechanical performance parameter of the beverage dispensing device;
a volume in the final dispense chamber; and
a property of the beverage.

25. The beverage dispensing device of claim 23, wherein the expected standard includes at least one of:
a safety standard; and
a quality standard;
wherein the expected standard is based on reference values; and
wherein the reference values for the safety standard and for the quality standard are different.

26. The beverage dispensing device of claim 23, wherein:
the waste container includes an RFID tag; and
the sensor senses the waste container via the RFID tag.

27. A beverage dispensing device comprising:
a detachable final dispense chamber, wherein the beverage dispensing device is configured to mix a beverage and store the beverage in the final dispense chamber prior to a final dispense of the beverage from the beverage dispensing device;
a dispenser for the final dispense chamber; and
a display;
wherein the beverage dispensing device is configured to:
determine at least one parameter of the beverage;
at least one of: (i) lock the dispenser if the at least one parameter does not satisfy an expected standard; and (ii) unlock the dispenser if the at least one parameter does satisfy the expected standard; and
indicate, via the display, that the final dispense chamber should be emptied when the beverage dispensing device locks the dispenser.

28. A beverage dispensing device comprising:

a final dispense chamber, wherein the beverage dispensing device is configured to mix a beverage and store the beverage in the final dispense chamber prior to a final dispense of the beverage from the beverage dispensing device;

a dispenser for the final dispense chamber; and a waste outlet of the final dispense chamber;

wherein the beverage dispensing device is configured to:

determine at least one parameter of the beverage;

at least one of: (i) lock the dispenser if the at least one parameter does not satisfy an expected standard; and (ii) unlock the dispenser if the at least one parameter does satisfy the expected standard; and drain the beverage through the waste outlet of the final dispense chamber if the at least one parameter does not satisfy the expected standard.

29. A beverage dispensing device comprising:

a final dispense chamber, wherein the beverage dispensing device is configured to mix a beverage and store the beverage in the final dispense chamber prior to a final dispense of the beverage from the beverage dispensing device;

a dispenser for the final dispense chamber;

a pneumatic system; and a sensor of the pneumatic system;

wherein the beverage dispensing device is configured to:

determine at least one parameter of the beverage; and at least one of: (i) lock the dispenser if the at least one parameter does not satisfy an expected standard; and (ii) unlock the dispenser if the at least one parameter does satisfy the expected standard;

wherein the at least one parameter of the beverage is determined based on measurements from the sensor of the pneumatic system.

30. A method for a beverage dispensing device comprising:

mixing a beverage in a mixing area of the beverage dispensing device;

storing the beverage in a final dispense chamber of the beverage dispensing device;

determining at least one parameter of the beverage;

locking a dispenser of the beverage dispensing device, if the at least one parameter does not satisfy an expected standard; and draining the beverage through a waste outlet of the final dispense chamber if the at least one parameter does not satisfy the expected standard.

* * * * *